United States Patent [19]

Kirschbaum

[11] 4,012,920

[45] Mar. 22, 1977

[54] HEATING AND COOLING SYSTEM WITH HEAT PUMP AND STORAGE

[75] Inventor: Herbert S. Kirschbaum, Wilkins Township, Pa.

[73] Assignee: Westinghouse Electric Corporation, Pittsburgh, Pa.

[22] Filed: Feb. 18, 1976

[21] Appl. No.: 658,946

[52] U.S. Cl. ..... 62/2; 62/324; 126/400; 137/596.16; 237/2 B

[51] Int. Cl.[2] ..... F25B 27/00

[58] Field of Search ..... 62/2, 238, 324; 237/2 B; 126/400; 137/596.16

[56] References Cited

UNITED STATES PATENTS

| | | | |
|---|---|---|---|
| 2,204,394 | 6/1940 | Bailey | 237/2 B X |
| 2,260,477 | 10/1941 | Newton | 237/2 B X |
| 2,693,939 | 11/1954 | Marchant et al. | 237/2 B X |
| 3,411,538 | 11/1968 | Gruner et al. | 62/324 X |
| 3,916,638 | 11/1975 | Schmidt | 62/238 |
| 3,926,008 | 12/1975 | Webber | 62/238 X |

*Primary Examiner*—William E. Wayner
*Assistant Examiner*—William E. Tapolcai, Jr.
*Attorney, Agent, or Firm*—E. C. Arenz

[57] ABSTRACT

A heating and cooling system is provided which includes a reversible heat pump with three refrigerant coils, one of which is in an air duct for the space to be served, another of which is in heat exchange relation with outdoor air, and a third of which is adapted to exchange heat with a heat exchange fluid which is circulated from a heat storage location, the system including valve means in the refrigerant lines for connecting any of the three coils to operate as either an evaporator or a condenser and for connecting either one of the other two coils to operate as a condenser or evaporator, respectively, so that heat can be exchanged in any combination between air in the duct serving the space to be heated, outside air, and the storage fluid. The system also preferably includes a solar collector and a second fluid storage tank, and circulating means and fluid valve means as well as a fluid-to-air heat exchanger in the duct so that heat from solar insulation may be used to heat directly or placed in storage, or heat may be provided for the space directly from the storage. Heat from storage may also be used with the heat pump operating. Various other modes of heat pump operation are also available in a cooling operation.

The system also includes the provision of a diverting valve arrangement for the three coil heat pump which precludes, through a physical blocking arrangement, the possibility of short circuiting the discharge from the refrigerant compressor to the suction side of the compressor.

16 Claims, 5 Drawing Figures

HEATING AND COOLING SYSTEM WITH HEAT PUMP AND STORAGE

BACKGROUND OF THE INVENTION

1. Field of the Invention

The invention pertains to the art of hearing and cooling systems utilizing reversible heat pumps, heat storage arrangements, and a solar collector arrangement associated with the heat pump.

2. Description of the Prior Art

Of the prior art patents of which I am aware, U.S. Pat. No. 3,759,055 is of interest in that it discloses a reversible heat pump with which three coils are associated in the over-all system. However, the third coil in that arrangement is in parallel with a first coil and effectively therefore is performing basically the same function as the first coil and is not susceptible of being used along without the first coil functioning. Also, the thrust of the noted patent appears to be the provision of heating or cooling a heat transfer fluid for current use without provision for storage of the heat transfer fluid so that its heat content or lack thereof, may be subsequently drawn upon.

As to the concept of providing a heating cooling system using at least two separate temperature storage units, as well as incorporating a solar collector along with a refrigeration system, this is acknowledged to be known as evidenced by U.S. Pat. No. 2,575,478, for example. However, in that patent as well as other similar patents disclosing two-temperature storage reservoirs with or without solar collectors, there is no provision for the use of the stored heat or lack thereof in connection with a three coil reversible heat pump and a fluid line arrangement which yields the versatility of the arrangement according to the present invention.

Accordingly, it is the aim of the present invention to provide a highly-versatile heating and cooling system which is sufficiently flexible in its modes of operation to effectively utilize various sources of energy for heating and cooling in an energy conserving manner.

SUMMARY OF THE INVENTION

In accordance with the invention in its broader aspect, the heating and cooling system includes a storage means for a heat exchange fluid, an air passage means through which air to heat and cool to serve spaces is passed, a reversible heat pump including a refrigerant compressor, a first refrigerant coil in the air passage means, a second refrigerant coil in heat exchange relation with outdoor air, a third refrigerant coil for exchanging heat with the fluid from the storage means, refrigerant line means connecting the compressor to the coils, and valve means in the refrigerant line means for connecting any one of the three coils to operate as either an evaporator or a condenser and for connecting either one of the other two coils to operate as a condenser or evaporator, respectively, so that heat can be exchanged in any combination between air in said passage means, outside air and said storage fluid.

It is also contemplated that second storage means be provided along with solar insolation collector means and that fluid line means connect the first and second storage means and collector means, with fluid flow control means being provided to control the flow of fluid between the storage means and collector means in accordance with temperature conditions and the operating mode of the heat pump.

The invention also includes the provision of various pump and valve means for effecting and controlling the flow of the heat exchange fluid in different circuits, and also provides a diverting valve arrangement for the refrigerant flow which is powered by the differential pressure existing at different parts in the refrigeration system, which is fail-safe in the sense of precluding short-circuiting of the refrigerant compressor.

DESCRIPTION OF THE PREFERRED EMBODIMENTS

Figure 1:
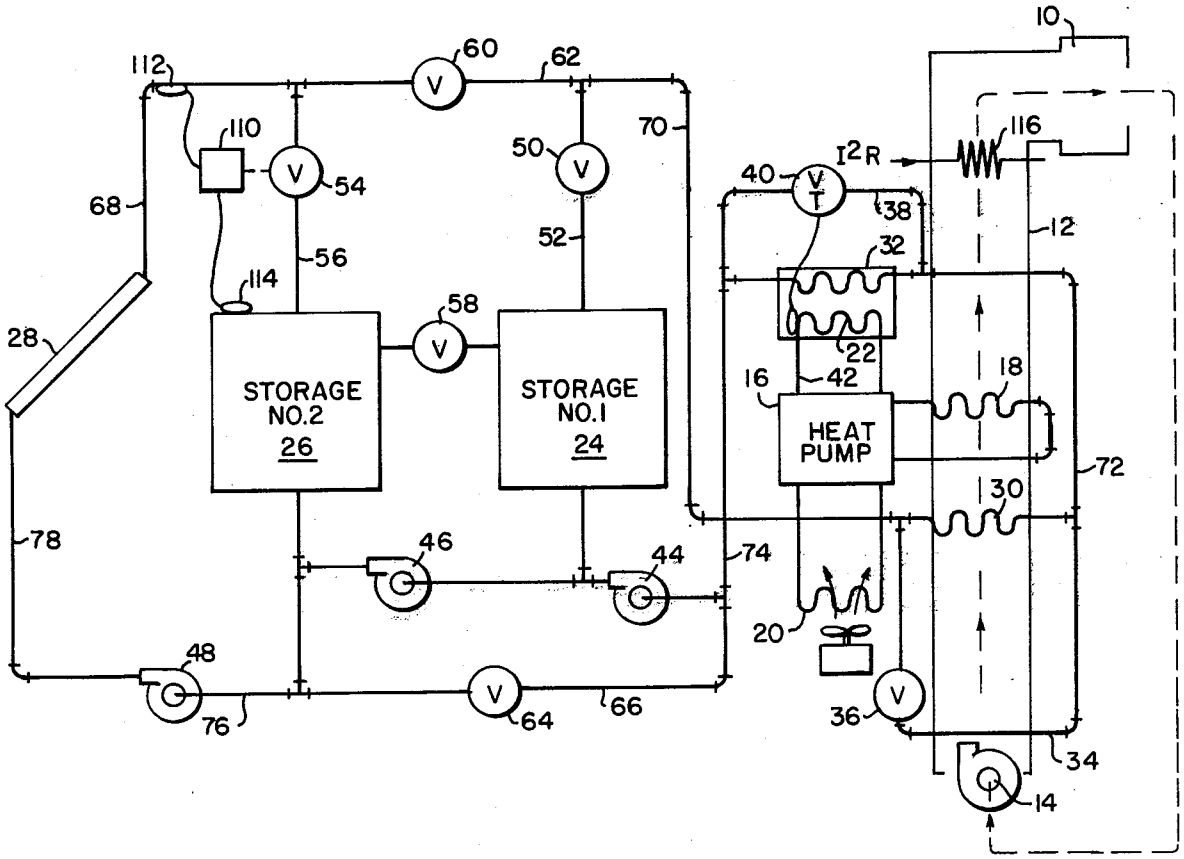
FIG. 1 is a schematic view of the basic heating and cooling system of the invention.

Referring to FIG. 1, the space to be heated and cooled by the system shown schematically is indicated by the numeral 10 to which the air passage or duct 12 is connected and through which air is moved by the blower 14. A reversible heat pump 16 is arranged, as will be explained later, with three separate refrigerant coils, the first one 18 being located in the duct 12, the second one 20 being in heat exchange relation with outdoor air, and the third one 22, which will be called a storage coil, being adapted to exchange heat with a heat exchange fluid such as water, or in some cases, a fluid having a freezing point below that of water, and which is circulated throughout the system in accordance with temperature conditions and the operating mode of the heat pump. In the embodiment shown in FIG. 1, the storage coil 22 is illustrated as being external to a fluid storage tank and as such may take the form of the conventional shell and tube heat exchanger. It will be appreciated that the physical arrangement could be such that the storage coil 22 would be immersed in a storage tank to effect the heat exchange to the fluid.

The system also includes first storage means 24 and second storage means 26 for the heat exchange fluid, as well as a solar insolation collector 28 all being connected to each other by various fluid line means which will be subsequently identified. The fluid system includes a fluid-to-air heat exchanger 30 located in the duct 12, and a fluid-to-refrigerant heat exchanger 32 which incorporates the storage coil 22 therein. The heat exchanger 30 has a bypass line 34 around it with a valve 36 in the line to control whether the fluid flow is through the heat exchanger 30 or around it through the bypass line 34. The heat exchanger 32 also has a bypass line identified as 38 and a valve 40 which preferably is of the modulating type and is controlled under some operating modes of the heat pump in accordance with the exit temperature of the storage coil 22 through a sensor 42 arrangement.

The means for controlling the flow of the heat exchange fluid is accomplished by various pump means and valve means which, for purposes of clarity in the explanation, are shown as individual pumps and valves although it will be appreciated that in a working embodiment, some of these pumps and valves may be consolidated. The fluid pumps shown include pump 44 associated with the first storage tank, pump 46 associated with the second storage tank, and pump 48 associated with the solar collector. The valves include valve 50 in line 52 from the first storage tank, valve 54 in the line 56 from the second storage tank, valve 58 between the two tanks, valve 60 in line 62, and valve 64 in the bypass line 66 around the pumps 44 and 46. The additional connecting fluid lines which will be identified for explanatory purposes include line 68 from the solar collector to the line 62 in which valve 60 is located, line 70 extending from line 62 to the junction of the bypass line 34 and the fluid-to-air heat exchanger 30, line 72 from the downstream end of the coil 30 to the junction of the bypass line 38 and the fluid-to-refrigerant heat exchanger 32, line 74 from the downstream end of what heat exchanger to the junction of pump bypass line 66 and the line which lead to pump 44, line 76 connecting the downstream end of line 66 to the solar collector pump 48, and line 78 leading from that pump to the solar collector.

Figure 2:
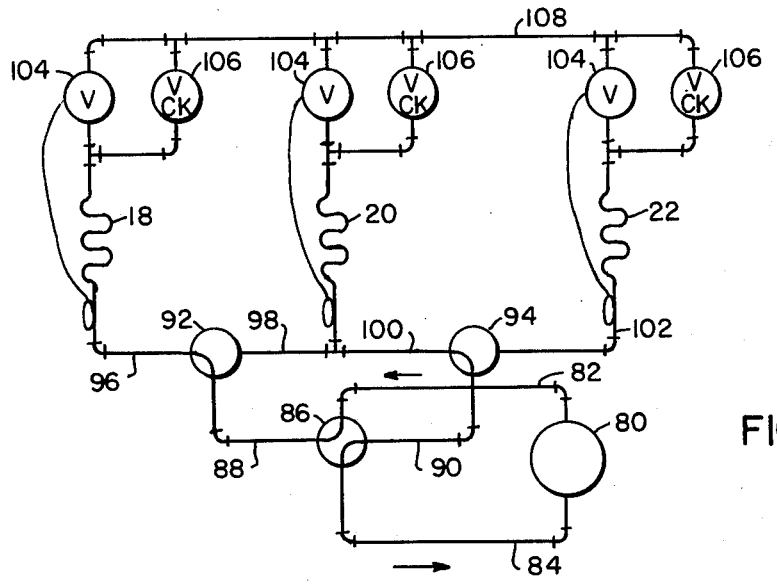
FIG. 2 is a schematic view of a three-coil reversible heat pump arrangement according to the invention.

Referring now to FIG. 2 for more detail as to the arrangement of the three coil, reversible heat pump, the refrigerant compressor 80 is connected through discharge line 82 and suction line 84 to reversing valve 86, which in turn is connected through lines 88 and 90 to diverting valves 92 and 94. Diverting valve 92 in its illustrated position connects line 88 to line 96 leading to one end of indoor coil 18. In its opposite position, the diverting valve 92 connects line 88 to line 98 which connects both to one end of the outdoor coil 20, as well as line 100 which is connected to the diverting valve 94 and to line 90 when diverting valve 94 is in the illustrated position. Diverting valve 94 in its position opposite that shown in FIG. 2 places line 90 in communication with line 102 leading to an end of the storage coil 22.

As is conventional with the ordinary two coil reversible heat pump, thermostatic expansion valves or other expansion devices 104 are provided in association with each of the coil along with the usual paralleling check valves 106. Line 108 connects the one side of these devices in common.

The table following gives information as to the positioning of the diverting valves 92 and 94, and reversing valve 86, as well as which coil is functioning as an evaporator and a condenser for the six heat pump operating modes. The right-hand column of the table states the basic intended purpose of the operating mode as well as the direction of heat flow.

(Table)

| Heat Pump Operating Modes | Evaporator Coil | Condenser Coil | Diverting Valve 92 Connects Lines | Diverting Valve 94 Connects Lines | Reversing Valve 86 Connects Lines | Purpose And Heat Flow |
|---|---|---|---|---|---|---|
| I | Outdoors | Indoors | 88 – 96 | 90 – 100 | 82 – 88<br>84 – 90 | Heat - From Outdoors |
| II | Indoors | Outdoors | 88 – 96 | 90 – 100 | 82 – 90<br>84 – 88 | Cool - To Outdoors |
| III | Storage | Indoors | 88 – 96 | 90 – 102 | 82 – 88<br>84 – 90 | Heat - From Storage |
| IV | Indoors | Storage | 88 – 96 | 90 – 102 | 82 – 90<br>84 – 88 | Cool - To Storage |
| V | Storage | Outdoors | 88 – 98 | 90 – 102 | 82 – 88<br>84 – 90 | Cool and<br>Cool - To Outdoors<br>Storage<br>Fluid |
| VI | Outdoors | Storage | 88 – 98 | 90 – 102 | 82 – 90<br>84 – 88 | Heat - From Outdoors<br>Storage |

The explanation of the operation of the heating and cooling system and the heat pump in several of the operating modes will proceed in connection with the table and FIGS. 1 and 2.

HEATING MODES

Heating From Solar Energy Alone

In the case where heating of the served space 10 is desired and there is adequate heat to be derived from the solar collector 28 alone, the valves 36, 50 and 54 are closed to isolate the storage tanks from the heat exchange fluid circuit, and valves 40, 60 and 64 are in an open position with pump 48 operating. Thus, the flow of heat exchange fluid from the solar collector 28 is through lines 68, 62, 70, through fluid-to-air heat exchanger 30, lines 72, 38, 74, 66, 76 to pump 48 and line 78 back to the solar collector. An additional fluid circuit is available when the solar heated fluid is being used to heat the served space, the additional circuit being one in which the valve 58 is opened and pump 46 is energized to mix the fluid in the two storage tanks.

Heating From Storage Directly

When solar heat is indequate to supply all the heat necessary for the served space, but there is significant heat content in the fluid in the storage means, a circuit for flowing the fluid to the heat exchanger 30 in the duct 12 may be set up as follows. Valves 36, 60 and 64 are closed while valves 40, and 50 are open and pump 44 is energized. The flow if fluid is thus from storage tank 24 through lines 52, 70, heat exchanger 30, lines 72, 38 and 74 back to pump 44.

Under some ambient conditions, it may be desirable to collect some low level heat in fluid in the solar collector 28 and store it in the second storage means 26. In this case as independent fluid circuit is established from solar collector 28, line 68, through valve 54 and line 56 to storage tank 26, line 76 to energized pump 48, and then line 78 to the solar collector. With this arrangement, it is considered preferable that there be means provided to control the flow in the solar collector to the second storage means in accordance with the temperature difference between the fluid from the collector and the fluid in the second storage means. This may be effected by providing a controller 110 which is responsive to the temperature difference between the solar heated fluid sensed by element 112 and the temperature of the storage fluid sensed by element 114. When the temperature of the solar heated fluid no longer exceeds the temperature of the storage fluid by a predetermined amount, the controller 110 will de-energize pump 48, and optically close valve 54.

Heating From Storage With Heat Pump Boost

When the fluid temperature in the storage means is too low for direct heating but is sufficiently higher in temperature than the outside air, it can be used as a heat source for the heat pump. For the fluid circuit for this operation, the valves 40 and 60 are closed while the valves 36 and 50 are opened and the pump 44 is energized thus the fluid circuit is from storage tank 24 through line 52 to line 70, then through valve 36 and bypass line 34 to line 72, and through the fluid-to-refrigerant heat exchanger 32, with the fluid returning through line 74 to pump 44.

In this heating mode of operation for the system as a whole, the heat pump operating mode is that of III of the table in which the indoor coil 18 functions as a condenser and the storage coil 22 functions as an evaporator to absorb heat from the heat exchange fluid. In some of the colder climates, the heating obtained in this way may be inadequate for the served space, and in this case, electrical resistance heating 116 may be energized to supplement the system.

If under certain operating conditions in the III mode there is a potential problem with the upper limit of evaporating temperatures, valve 40 may be a modulating valve which limits the evaporator exit temperature in this mode of operation sensing that temperature with element 42 and modulating the valve 40 to permit some bypass.

Another temperature condition which may exist is that the storage temperature is somewhat too high for satisfactory operation of the heat pump in the III mode and is too low for direct heating of the air passing through the duct. In this case, the valve 36 may be closed to prevent the bypass of the warm fluid through the bypass line 34 and directing it through the fluid-to-air heat exchanger 30. The result of this is that there is a reduction in the temperature of the fluid entering the fluid-to-refrigerant heat exchanger 32, and at the same time, there has been a transfer of heat from the heat exchanger 30 to preheat the air passing to the indoor coil 18 of the heat pump. While in this variant of operation, there will typically be a slight decrease in the coefficient of performance of the heat pump, this will typically occur where the COP is quite high and will have negligible effect on the efficiency of operation as a whole.

It will also be understood that during this general type of operation, the circuit which includes the solar collector 28 and the second storage tank 26 may be used independently of the circuit by which heating from the first storage tank via the heat pump is being accomplished, whether or not the independent circuit is functioning being dependent upon the relationship between the solar energy available and the temperature of the fluid in the independent circuit.

Heating With Air-To-Air Heat Pump Operation

When both the storage heat has been depleted and there is insufficient solar energy to provide heat for the served space, the heat pump is placed into operating mode I in which the indoor coil 18 functions as the condenser of the heat pump and the outdoor coil 20 functions as the evaporator. At this time, there may still be sufficient solar energy available to justify operating the circuit which includes the solar collector and the second storage tank 26.

Another case in which the heat pump might be operated in mode I is when the outside air temperature is sufficiently high that the COP in mode I would exceed that which would be obtained by using the storage fluid as the heat source, even though that storage fluid has a sufficiently high temperature that it functions satisfactorily as the heat source for the heat pump.

Heat To Source

Under some temperature conditions during a heating season, the air outside may be sufficiently warm, during the day particularly, that insignificant heat is required for the served space. Under such conditions, the heat pump operating mode VI may be used in which the outdoor coil 20 functions as an evaporator and the storage coil 22 functions as a condenser which will exchange heat to the heat exchange fluid for storage in the storage means. The stored heat may subsequently be drawn upon, such as night, by circulating it through the heat exchanger 30. Also, to the extent that it may be desirable to exchange some heat with the air passing through the duct 12 while at the same time having a net increase in stored heat, the heat exchange fluid may be passed through the heat exchanger 30 rather than the bypass line 34 on its way to the heat exchanger 32.

At the same time the heat pump is in its operating mode VI, the solar collector circuit with storage tank 26 may also be in operation. Under some conditions, it may also be desirable to open valve 58 between the two storage tanks so that the fluids at different temperatures may be mixed.

COOLING MODES

Conventional Air Conditioning Cooling

In the heat pump operating mode II the indoor coil 18 functions as an evaporator and the outdoor coil 20 functions as a condenser so that the resulting operation is that of a conventional air conditioner. During this type of operation, the solar collector 28 may be used in conjunction with the second storage tank 26 for the purpose of heating water, if that is the storage fluid, which may be used for domestic hot water heating.

Cooling With Heat To Storage

Under some temperature conditions, such as when the outside temperature is relatively high as compared to the temperature of the storage fluid in the first storage tank 24, the heat pump operating mode IV may be advantageously used. In this case, the indoor coil 18 functions as an evaporator while the storage coil 22 functions as a condenser. The net result of this, of course, is to pump heat from the served space into the storage fluid. Typically it would be expected that this mode of operation would be carried out during the day.

Night Cooling and Storage Heat Rejection

The build-up of heat in the storage fluid resulting from the immediately preceding operation may be pumped to the outdoors by using the heat pump operating mode V. In this case, the storage coil 22 functions as an evaporator and the outdoor coil 20 functions as a condenser. This operating mode would typically be used during periods when the outside air temperature is relatively cool (such as a summer night) as compared to the outside air temperature during the immediately preceding operation (such as during a summer day).

To the extent that the operating mode V is continued long enough, the storage fluid temperature may be pumped down considerably. By doing this on cool summer nights, the COP of the heat pump is relatively high and this type of operation may also permit the use of off-peak energy resulting in financial economy where day-night rate differentials are available. If cooling of the served space is also required during these periods when the storage fluid temperature has been lowered significantly, the cooling may be effected by circulating the water through the heat exchanger 30 in the duct 12.

During daytime periods, the cooled storage fluid may also be passed through the heat exchanger 30 and the heat pump operated in mode II in which heat is pumped to the outdoors so that the cooling effect from the storage fluid and from the heat pump is additive.

It will be appreciated that whether heat pump operating mode II or IV is used (and V in conjunction therewith ), will depend upon the relation between outside temperatures and the storage fluid over any given time period.

DIVERTING VALVE ARRANGEMENT

Referring to FIG. 2, it will be seen that if diverting valve 92 were in a position connecting line 88 to line 98 while diverting valve 94 was in a position connecting line 90 to line 100, the compressor discharge would be connected directly to the compressor suction in a short circuit. If such a condition were to persist for a sufficient period, the compressor motor would be subject to being burned out. While electrical interlocks could be used to reduce the chance of such an occurrence, there is always the possibility of a mechanical malfunction in one of the valves causing the short circuiting to arise. Thus, as in a preferred diverting valve arrangement, such as is shown in FIG. 3, the mechanical arrangement is such that it is impossible to have a short circuit of the compressor discharge to the compressor suction.

Figure 3:
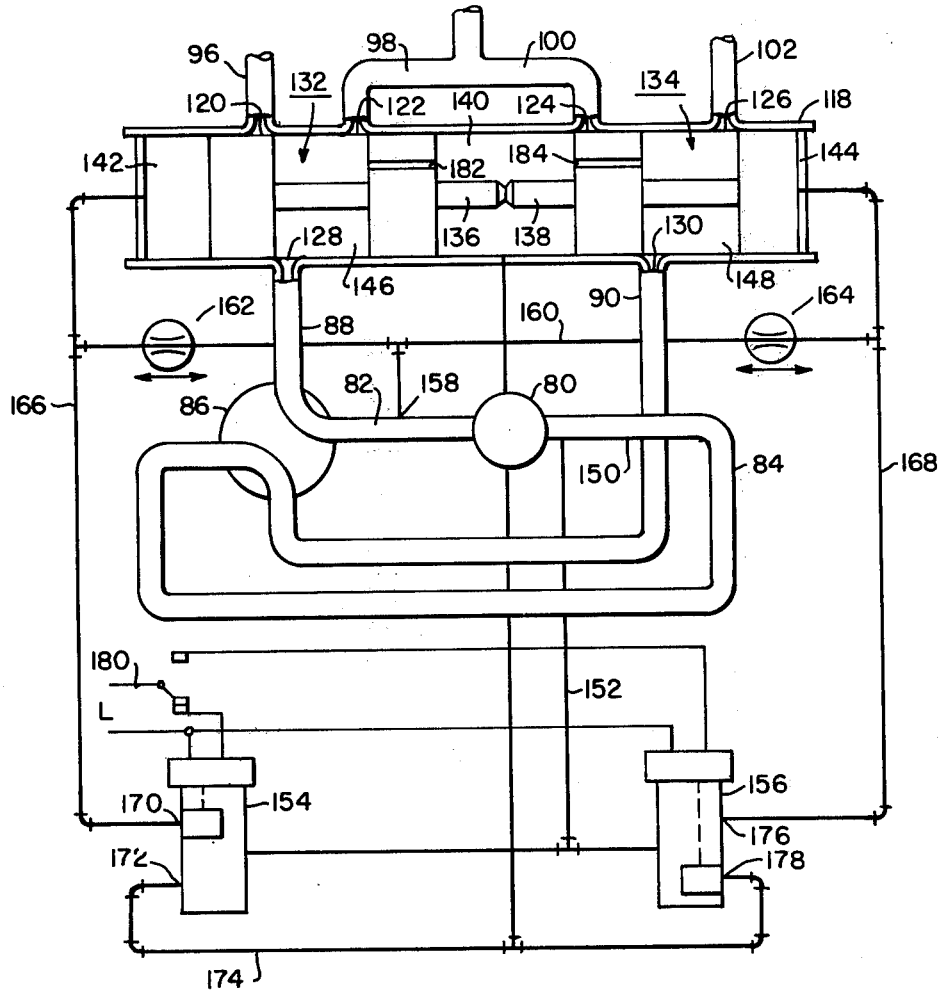
FIG. 3 is a diagrammatic view of a preferred form of diverting valve arrangement for the three-coil heat pump.

Referring to FIG. 3, the basic arrangement of the valve includes a cylindrical shell 118 with one set of four ports, 120, 122, 124 and 126, spaced along the length of the shell. The first port 120 is open to line 96 connected to the indoor coil, the second port 122 is connected to line 98 connected to one end of the outdoor coil, port 124 is connected to line 100 which also connects to one end of the outdoor coil, and port 126 is open to line 102 connected to the storage coil.

Another set of two ports, 128 and 130 are located at other points along the shell so that the fifth port 128 opens to the space between the first and second ports and the sixth port 130 opens to the space between the third and fourth ports. The fifth and sixth ports are open as shown to line 88 and line 90 connected at their other ends to the reversing valve 86.

The shell contains two movable, double piston assemblies 132 and 134. As may be seen in FIG. 3, the piston assemblies are dimensioned in length such that their shaft portions 136 and 138 extend into the intermediate chamber 140 so that at no time may both ports 122 and 124 be uncovered at the same time.

Besides the intermediate chamber 140, the shell and piston assemblies also define opposite end chambers 142 and 144 and refrigerant passage chambers 146 and 148 between the double pistons of each piston assembly.

From FIG. 3, it should be apparent that the double piston assemblies have only three operating positions, which are: both assemblies to the right, as shown, both assemblies to the left, and each assembly at its respective end of the shell. The covering and uncovering of the various ports in these three positions may be easily perceived from FIG. 3.

The motive force for operating the diverting valve arrangement of FIG. 3 is derived from the pressure differential between the compressor discharge pressure and compressor suction pressure. To this end, the compressor suction pressure is tapped off from line 84 at point 150 and delivered by line 152 to pilot valves 154 and 156.

Discharge pressure is tapped off at point 158 from the compressor discharge and is passed through line 160 and metering orifices 162 and 164 to lines 166 and 168, both of which are connected at one end to an expansion chamber at an end of the shell 118 and at their other ends to ports in the bodies of the pilot valves 154 and 156.

Pilot valve 154 has an outlet port 172 open to line 174 which connects to the intermediate chamber 140, and an outlet port 170 connected to line 166. Pilot valve 156 has outlet ports 176 and 178 which are similarly connected.

The two valves together may have any of three positions: both deenergized in which case both ports 172 and 178 are covered and ports 170 and 176 are open; the position shown, in which the solenoid coil operating valve 154 is energized while the solenoid coil for valve 156 is deenergized and in which port 172 of valve 154 is open and port 176 of valve 156 is open; and a position in which the solenoid coil of valve 156 is energized and the solenoid coil 154 is deenergized (the opposite of that shown in FIG. 3) and in which case port 170 of valve 154 is open and port 178 of valve 156 is open, with the other ports of the two valves being closed. To ensure that both solenoid coils cannot be energized at the same time, the three-position switching device 180 is provided with front and back contacts.

Both of the double piston assemblies are provided with bleed passages 182 and 184 which place the two passage chambers 146 and 148 in restricted communication with the intermediate chamber 140 for a purpose which will become apparent from the following explanation of the operation of the diverting valve.

In the position shown in FIG. 3, the coil of solenoid 154 is energized while that of 156 is deenergized. Accordingly, the suction condition derived from line 152 is communicated through valve 156 and its open port 176 and line 168 to the end chamber 144. The application of suction to the opposite end chamber 142 through valve 154 is precluded by the closure of port 170. However, the suction is also applied through the port 172 of valve 154, and thence through line 174 to the intermediate chamber 140. Since the line 166 leading to the end chamber 142 is blocked from suction, it receives only discharge pressure through the metering orifice 162 in line 160. Thus the pressure conditions existing in the various chambers of the valve, in sequence from left to right, are as follows: End chamber 142—discharge pressure; passage chamber 146—discharge pressure; intermediate chamber 140—suction; passage chamber 148—suction; and end chamber 144—suction. In this condition the differential pressure between the passage chamber 146 and the intermediate chamber 140 will maintain both of the double piston assemblies in their right-hand position.

Upon moving switch 180 to a neutral position in which neither of the solenoid operated valves is energized, the valve 154 will be in a position blocking port 172 and opening port 170 so that suction will be applied through line 166 to the end chamber 142. The metering orifice 162 restricts the rate at which high pressure refrigerant can bleed into the line 166 to a value which permits the suction pressure application to overcome the bleed through of the high pressure refrigerant. The bleed passages 182 and 184 permit high pressure refrigerant to bleed from the passage chamber 146 to the intermediate chamber 140, and to an extent from that chamber to the other passage chamber 148 with the result that an intermediate pressure between the discharge pressure and the suction pressure results in the intermediate chamber 140. This provides the imbalance of forces acting upon the left-hand double piston assembly so that it will be moved to the left to a position placing the ports 128 and 120 in communication through the passage chamber 146.

If the valve 156 is operated to its energized position with the left-hand double piston assembly already in its left-hand position, the end chamber 144 will ultimately have a build-up in pressure and through an action similar to that described in connection with the movement of the left-hand double piston assembly to the left, the right-hand piston assembly will move to the left until the ends of the shafts 136 and 138 abut.

It will be apparent from the foregoing description that the diverting valve arrangement described precludes the possibility of both of the double piston assemblies 132 and 134 being in a position permitting short circuiting from the discharge side of the compressor to the suction side.

OTHER HEAT PUMP ARRANGEMENTS

Figure 4:
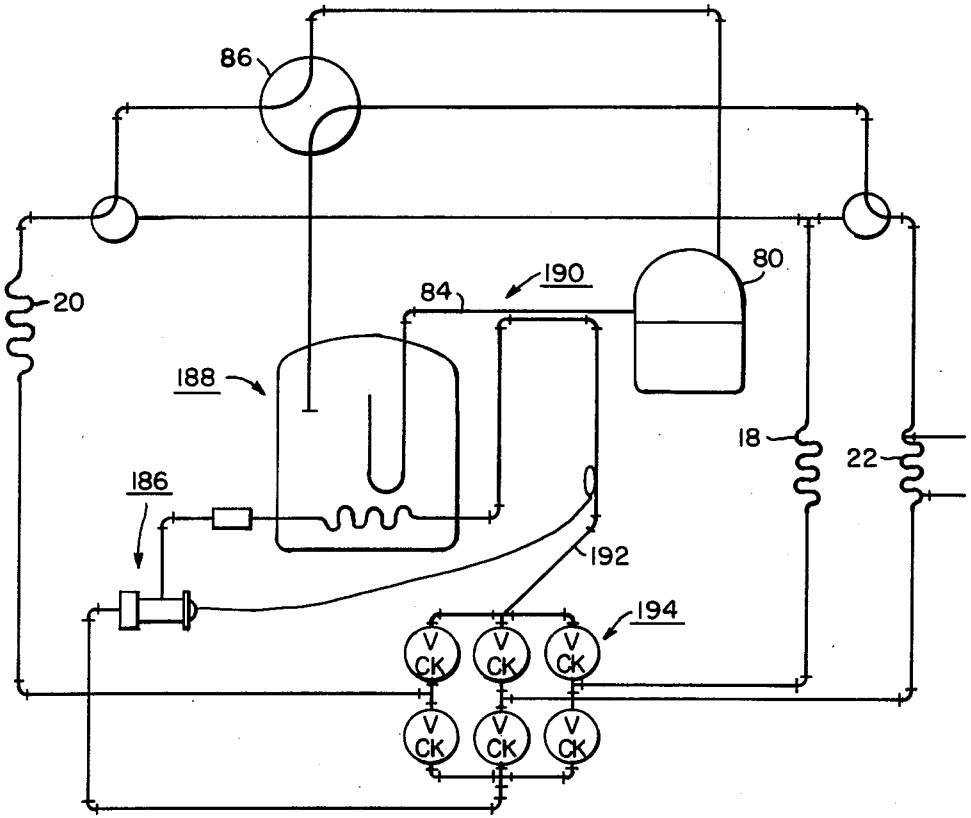
FIG. 4 is a schematic view of another form of three-coil heat pump which may be advantageously used in connection with the invention.

While the description has proceeded in connection with the configuration of a generally conventional heat pump as in FIG. 2 for purposes of explanation, the heat pump configuration for carrying out the invention may also take the form of that shown in FIG. 4 which derives its basic characteristics in accordance with the teachings of U.S. Pat. No. 3,423,954 and 3,264,837.

The basic differences between the system shown in FIG. 2 and that shown in FIG. 4 include a sub-cooling control valve 186, an accumulator-heat exchanger 188, a heat exchange arrangement at the location designed 190 between the suction line 84 and the line 192, and a check valve system generally designated 194.

With the operation of the reversing valve 86 between its two positions, and the operation of the diverter valve arrangement between the three positions possible, all as explained in connection with FIG. 2, all of the six operating modes of the heat pump set forth in the table are available.

The advantages of using a heat pump configuration of the general type shown in FIG. 4 as contrasted to the conventional one of FIG. 2, are basically those set forth in the noted patents and include the benefit of better reliability at lower outside operating temperatures and better capacity when operating from high source temperatures.

Figure 5:
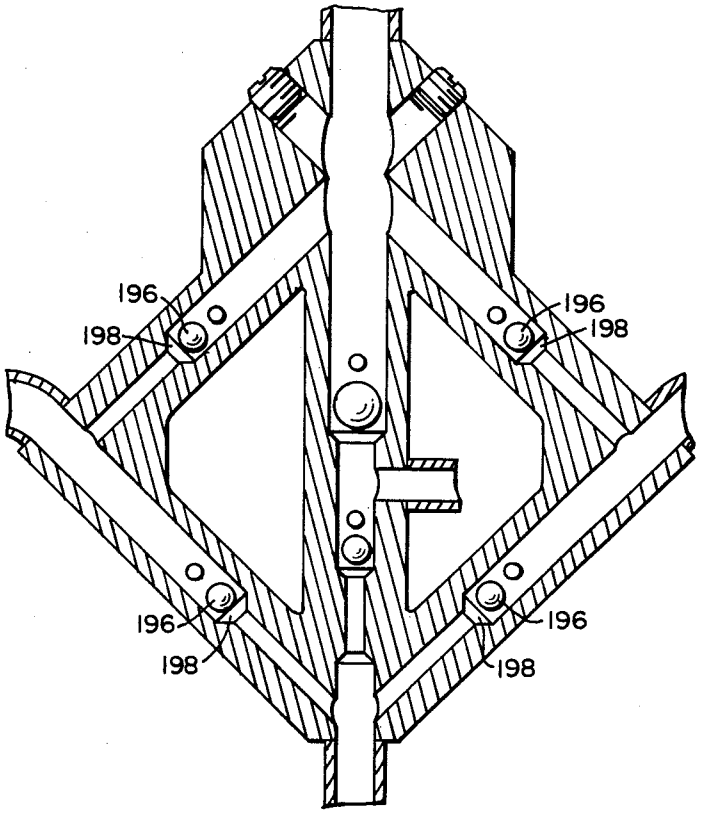
FIG. 5 is a partly-diagrammatic view of a manifold-type check valve arrangement which may be used in place of the check valve arrangement shown in FIG. 5.

The system of FIG. 4 would also lend itself to the use of a manifold check valve incorporating the principles of operation set forth in U.S. Pat. No. 3,299,661. A configuration of a manifold check valve adaped to be substituted for the check valve system 194 shown in FIG. 44 is shown in FIG. 5. In this arrangement of FIG. 5, six balls 196 are used with their respective seats 198 and a bleed passage (not shown) would be provided between the top and bottom connections of the arrangement shown in FIG. 5.

I claim:

1. A heating and cooling system including:
a heat exchange fluid;
first storage means for siad heat exchange fluid;
air passage means through which air to heat and cool the served space is passed;
a heat pump having a refrigerant compressor, a first refrigerant coil in said air passage means, a second refrigerant coil in heat exchange relation with outdoor air, a third refrigerant coil for exchanging heat with said fluid, and refrigerant line means connecting said compressor to said three coils;
valve means in said refrigerant line means for connecting any one of said three coils to operate as either an evaporator or a condenser and for connecting either one of the other two coils to operate as a condenser or evaporator, respectively, so that heat can be exchanged in any combination between air in said passage means, outdoor air, and said storage fluid.

2. A system according to claim 1 including:
a second storage means for said fluid;
solar insolation collector means;
fluid line means connection said first and second storage means and said collector means;
means to control the flow of fluid between said storage means and collector means in accordance with temperature conditions and the operating mode of said heat pump.

3. A system according to claim 2 including:
a fluid-to-air heat exchanger in said air passage means connected in said fluid line means.

4. A system according to claim 3 wherein:
said fluid flow controlling means includes independently operable pump means for at least one of said storage means and for solar collector, and valve means in said fluid line means to establish, selectively, a fluid circuit connecting said fluid-to-air heat exchanger to receive heated fluid directly from said collector and independently of said storage means, and another fluid circuit connecting said fluid-to-air heat exchanger to receive heated fluid directly from said first storage means and said second storage means to receive heated fluid from said collector.

5. A system according to claim 4 including:
means to control the flow of fluid from said collector to said second storage means in accordance with the temperature differential between the fluid from said collector and the fluid in said second storage means.

6. A system according to claim 1 including:
pump means for said first storage means;
a fluid-to-refrigerant heat exchanger incorporating said third refrigerant coil;
a fluid-to-air heat exchanger in said air passage means;
fluid line means connecting said first storage means, said pump means, and said two heat exchangers, said fluid line means including valve-controlled bypass lines around both of said heat exchangers; and said valve means in said refrigerant line means being operable to a position to connect said first refrigerant coil to function as a condenser, and said third refrigerant coil to function as an evaporator so that said storage fluid provides a heat source for said heat pump.

7. A system according to claim 6 including:

means for controlling the flow of said fluid through said bypass lines relative to the flow through said two heat exchangers in accordance with the temperature differential between said fluid and the refrigerant exiting said third coil.

8. A system according to claim 1 wherein said refrigerant valve means includes:

reversing valve means to connect a pair of refrigerant lines to the pressure and suction sides of said compressor in one way and an opposite way; and diverting valve means connected to said pair of refrigerant lines to connect either two of said refrigerant coils for operation and to block refrigerant flow through the third of said coils.

9. A system according to claim 8 wherein:

said refrigerant line means form a network in which one end of one of said coils is connected through a second pair of refrigerant lines to said diverting valve means, and said diverting valve means includes means blocking said diverting valve means from assuming a single position placing both of said second pair of refrigerant lines in open communication to both of said first pair of refrigerant lines

10. A heating and cooling system including:

a heat exchanger fluid;

a first storage means for said heat exchange fluid;

pump means for pumping fluid to and from said first storage means;

air passage means through which air to heat and cool the served space is passed a fluid-to-air heat exchanger in said air passageway;

a heat pump having a refrigerant compressor, a first refrigerant coil in said air passage means, a second refrigerant coil in heat exchange relation with outdoor air, a third refrigerant coil for exchanging heat with said fluid, and refrigerant line means connecting said compressor to said three coils;

a fluid-to-refrigerant heat exchanger incorporating said third refrigerant coil;

fluid line means connecting said first storage means, said pump means, and said two heat exchangers, said fluid line means including valve-controlled bypass lines around both of said heat exchangers;

means to control the flow fluid between said first storage means and said heat exchangers in accordance with temperature conditions and the operating mode of said heat pump;

valve means in said refrigerant line means for connecting any one of said three coils to operate as either an evaporator or a condenser and for connecting either one of the other two coils to operate as a condenser or evaporator, respectively;

said refrigerant line valve means having operating positions during a cooling season under one load condition in which said first coil functions as an evaporator and said second coil as a condenser, under a second load condition in which said third coil functions as an evaporator to cool said storage fluid and said second coil as a condenser, under a third load condition in which said first coil functions as an evaporator and said third coil as a condenser to transfer heat from the served space to the storage fluid, and under a fourth load condition in which said third coil functions as an evaporator and said second coil as a condenser to transfer heat from said storage fluid to the outdoor air.

11. A system according to claim 10 wherein:

said fluid line means is connected normally under said first load condition to bypass said fluid-to-air heat exchanger, and under said second load condition to feed said fluid-to-air heat exchanger in accordance with the demand for cooling of said served space.

12. A system according to claim 10 including:

a second storage means for said fluid;

solar insolation collector means;

said fluid line means includes additional fluid line means connecting said storage means and said collector means; and means to flow said fluid between said second storage means and said collector means independently of the flow of said fluid from said first storage tank.

13. In a reversible heat pump system having three refrigerant coils, any two of which are selectively operable at one time to operate as either evaporators or condensers, a diverting valve arrangement for connecting the coils to a reversing valve for the selective operation of the coils, comprising:

a cylindrical shell having four ports in communication with interior locations spaced axially along the length of the shell, the first of said four ports being connected to one end of the first refrigerating coil, the second and third of said four ports being connected to one end of the second refrigerating coil, and the fourth of said ports being connected to one end of the third refrigerating coil, and a fifth and sixth port in communication with interior locations at points along the length of said shell between the interior locations of said first and second ports, and said third and fourth ports, respectively, said fifth and sixth ports being connected to said reversing valve;

a pair of double piston assemblies in said shell, one of said assemblies being movable to open said fifth port to either said first or second port, and the other of said assemblies being movable to open sixth port to either said third or fourth port, said piston assemblies being dimensioned in length relative to length of said shell to physically preclude said second and third ports from both being open to said fifth and sixth ports, respectively, at any time, so that short circuiting of the compressor through the diverting valve is prevented.

14. In a system according to claim 13 wherein:

said shell and said piston assemblies define opposite end chambers, refrigerant passage chambers between each of the double pistons, and an intermediate chamber between the pair of double piston assemblies; and pilot valve means for controlling the application of suction pressure to said end chambers and said intermediate chamber to effect positioning of said double piston assemblies.

15. In a system according to claim 14 including:

means placing said opposite end chambers in restricted communication with the discharge of said compressors so that in the absence of the application of suction pressure to either said end chamber, said end chamber will be pressurized to move the adjacent piston assembly in a direction enlarging said end chamber.

16. A system according to claim 15 wherein:

said pistons at either end of said intermediate chamber include bleed passages placing said intermediate chamber in restricted communication with said passage chambers to permit the bleed of refrigerant between said intermediate chamber and said passage chambers.

* * * * *